United States Patent [19]

Mortellacci

[11] Patent Number: 4,526,370

[45] Date of Patent: Jul. 2, 1985

[54] POWER BILLIARD CUE ADAPTOR

[76] Inventor: Robert J. Mortellacci, c/o J. H. Steinberg, 2631 E.W. Hwy., Chevy Chase, Md. 20815

[21] Appl. No.: 617,330

[22] Filed: Jun. 4, 1984

[51] Int. Cl.[3] ..... A63D 15/08

[52] U.S. Cl. ..... 273/69

[58] Field of Search ..... 273/69; 124/37, 38

[56] References Cited

U.S. PATENT DOCUMENTS

| | | | |
|---|---|---|---|
| 497,929 | 5/1893 | Shumaker | 273/69 |
| 1,122,589 | 12/1914 | Graff | 273/69 |
| 1,157,909 | 10/1915 | Teague | 273/69 |
| 1,182,530 | 5/1916 | Doane | 273/69 |
| 3,246,895 | 4/1966 | Traill | 273/69 |
| 3,447,805 | 6/1969 | Baley, Jr. et al. | 273/69 |

*Primary Examiner*—William H. Grieb

[57] ABSTRACT

A cue stick comprised of two sections, an upper and lower tubular section wherein said lower section contains a steel rod whose lower half is fashioned to have 25 saw toothed shapes surrounded by a large spring for exerting force and a small spring at its upper part to serve as a damper and also containing two steel guide members, one that contains an indicator button that is movable and the other being fixed and containing a release button at the lower end of said rod.

2 Claims, 8 Drawing Figures

POWER BILLIARD CUE ADAPTOR

This invention relates to a billiard cue stick of a spring pressed plunger type which is structured to consist of two sections and which is adaptable for use by an amateur, disabled or a professional player.

A principle object of this invention is to provide a cue stick which can be adjusted so that spring power can be provided for 25 different power positions while, if it is desired to be used as an ordinary cue stick, it can be locked into fixed position so as to avoid use of said spring.

Another object of this invention is to firmly lock the cue stick in any one of 25 power positions so that sufficient pressure can be used to either shoot a cue ball lightly or even sufficiently hard so as to break a rack of billiard balls.

Another object is to provide a cue stick that can eliminate the use of a bridge because sufficient power is provided by the spring pressure.

Another object is to provide a cue stick that can be readily used to perform trick shots.

A further object is to provide a bumper spring to offset the force of the power spring.

It is realized that various spring actuated cue sticks of a plunger type have been designed but none of them has provided a cue stick which can be easily locked into any one of 25 positions so as to make it suitable for use in any position around a pool table.

A final object is to so construct the power adaptor so that it can be used for any two sectioned cue stick. it economical in cost and at the same time make it easy and quick to use.

The above and other objects of this invention will be apparent from the following description of the embodiment of the invention as shown in the accompanying drawings in which.

Figure 1:
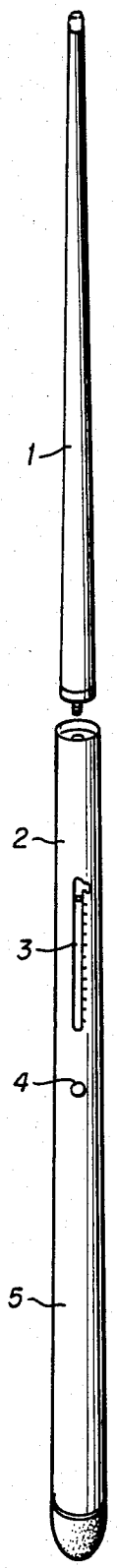
FIG. 1 shows a perspective view of the two section cue stick assembly.
Figure 2:
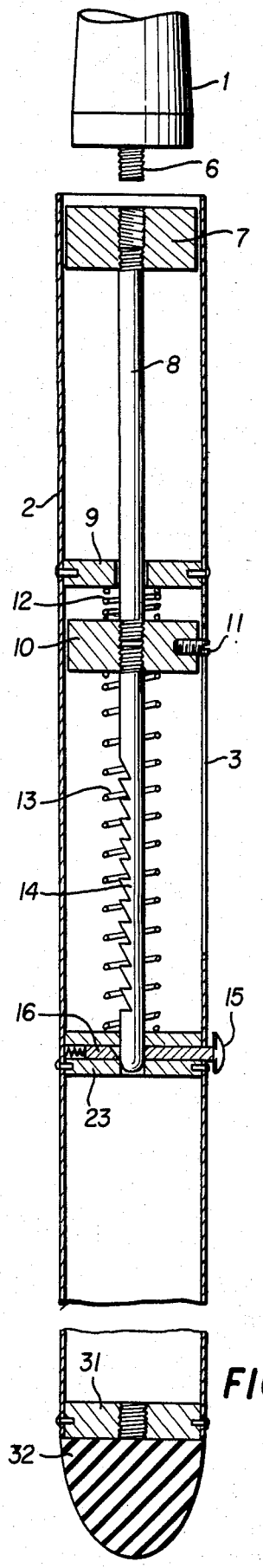
FIG. 2 shows a longitudinal cross-section through the operating mechanism in "rest" position.
Figure 3:
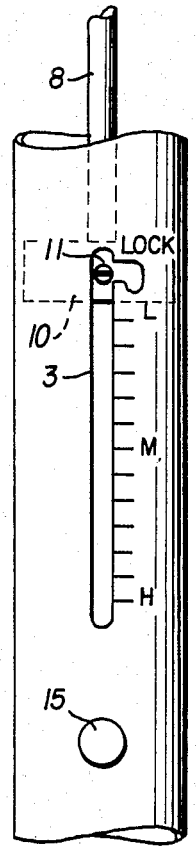
FIG. 3 shows a fragmentary elevation showing the indicator and lock mechanism in "rest" position.

In FIG. 1, there is shown a tubular two-section cue stick wherein the upper section 1 is screwed into the top of the lower adapter section 2, and wherein a simple locking indicator button 11 shown in FIG. 2 can be released to cause block 10 to be fixed into any one of 25 positions. By pressing release button 4 an internal spring will be released to provide the force needed to shoot a cue ball. The aluminum tube 5 has a thickness of 1/16 of an inch and a diameter of 1/14 inches. In FIG. 2, this tube houses a steel rod 8 whose upper end passes through a fixed plate 7 and a fixed plate 9 below which is located a bumper spring 12 to relieve excess pressure from the main spring. Indicator spacer plate 10 moves freely along the lower end of the bar which is saw toothed shaped at 14 with 25 teeth and surrounded by force spring 13. As shown in FIG. 3, indicator button 11 is locked into the low (L) position as shown on the indicator panel.

Figure 6:
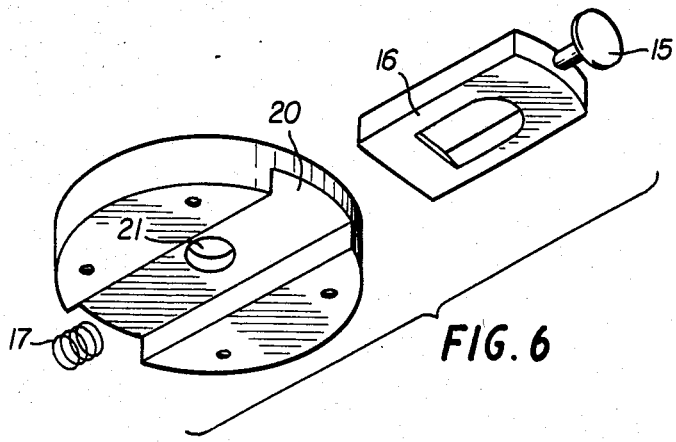
FIG. 6 shows a perspective view exploded of the trigger mechanism.
Figure 7:
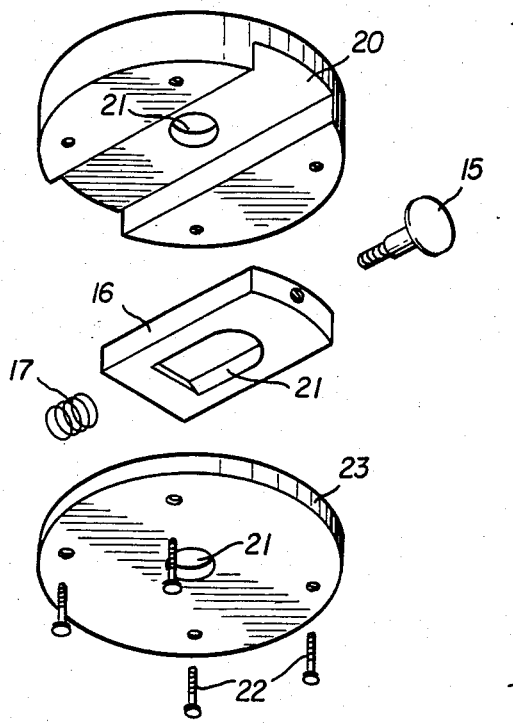
FIG. 7 shows a perspective view exploded of the trigger assembly.
Figure 8:
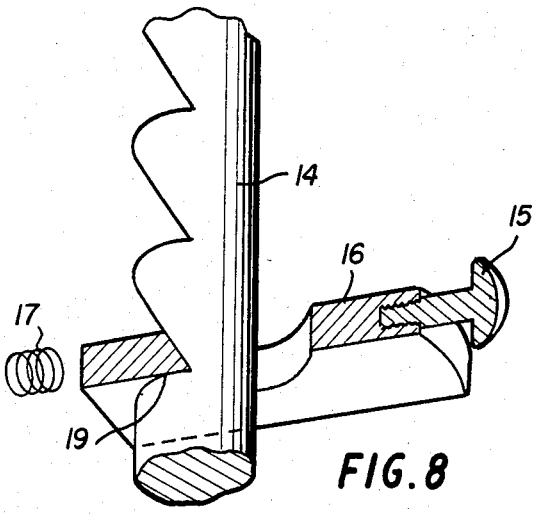
FIG. 8 shows an enlarged fragmentary perspective view showing engagement of the trigger bar.
Figure 4:
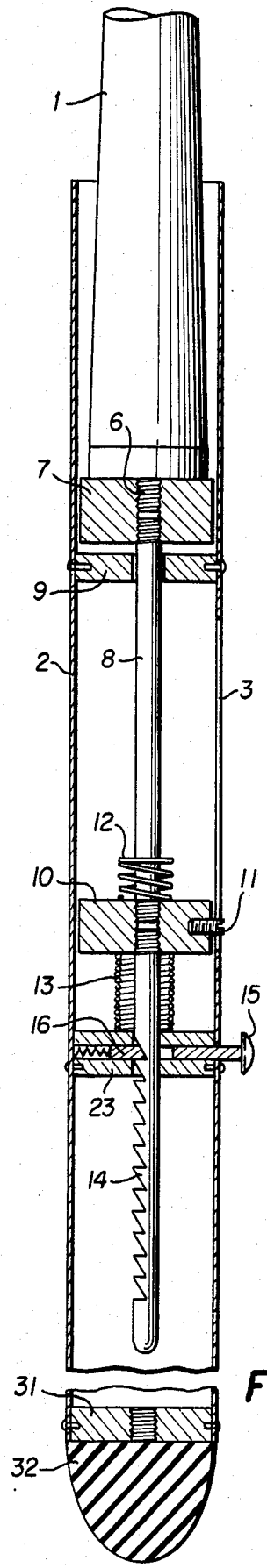
FIG. 4 shows a view similar to FIG. 2 but in "cocked" position.
Figure 5:
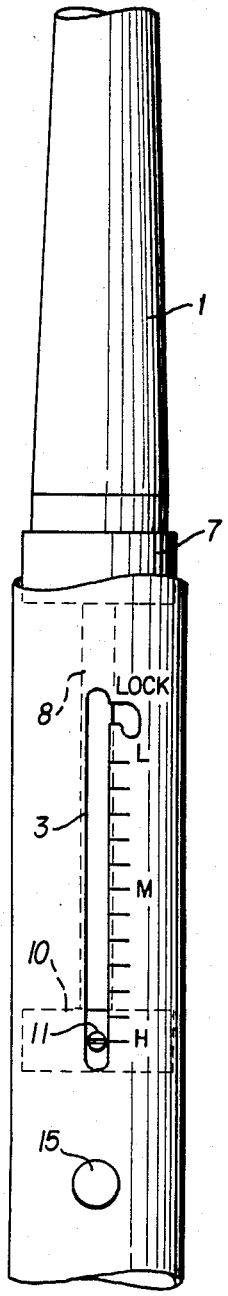
FIG. 5 is a view similar to FIG. 3 in "cocked" position.

In FIGS. 6, 7 and 8, there is shown the critical release trigger structure. This structure is riveted inside the tube and is composed of three sections wherein central block 16 with bearing spring 17 is sandwiched between blocks 20 and 23 with aligned openings 21 and are connected with screws 22. FIG. 8 shows steel rod 14 fitting a notched undercut opening 19 in block 16 to hold the said saw toothed rod. Pressing the release button 15 releases the spring to supply the force needed to hit the cue ball. In FIGS. 2 and 3, wherein the indicator pin is fixed at a low (L) position, makes this cue suitable for standard use. In FIGS. 4 and 5, the indicator pin is fixed at a position midway between medium (M) and high (H). In this position, when the release button 15 is pressed, the force of spring 13 will be available to strike the pool ball. By properly setting the indicator pin, enough force can be available even to break a rack of pool balls.

At the lower end of the cue stick, there is a screwed on sectional top of an aluminum band 31 and a rubber end 32 on bottom to protect the stick from injury.

This pool stick can be used as a standard pool stick or as one that will provide sufficient pressure to either make a pool shot or even to break a rack of balls. In addition, this cue stick can be used to make difficult or trick shots without the use of a bridge. Two sizes of pool sticks have been successively marketed, a standard length of 60½ inches and a shorter length of 54 inches. The pool stick with its adapter section that can fix the spring action at any one of 25 positions is ideal for use by a woman, by a beginner, or a disabled person. The ability to obtain enough force to break a rack of balls can only be accomplished by the pool stick of this invention.

What is claimed is:

1. An aluminum billiard cue stick comprised of two sections, an upper solid section which is screw attached to a lower section which comprises an adaptor that is a hollow tubular section, which can be used with any two sectioned cue stick, containing a steel rod having about 25 saw teeth surrounded by a long force spring which is preceeded by a short bumper spring and including a simple button to be pushed for locking and release of said force spring.

2. The cue stick of claim 1 wherein said button can lock said force spring with a mere twist of a wrist of a user so that said cue stick can be used like a standard one piece cue stick.

* * * * *